US007055715B2

(12) United States Patent
Maravich et al.

(10) Patent No.: US 7,055,715 B2
(45) Date of Patent: Jun. 6, 2006

(54) DRINK CUP AND LID

(75) Inventors: Milan C. Maravich, Evansville, IN (US); Jeffrey A. Mann, Evansville, IN (US); David J. Jochem, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 10 days.

(21) Appl. No.: 10/824,753

(22) Filed: Apr. 15, 2004

(65) Prior Publication Data

US 2005/0230406 A1 Oct. 20, 2005

(51) Int. Cl.
*B65D 39/00* (2006.01)

(52) U.S. Cl. ..... 220/792; 220/4.21

(58) Field of Classification Search ..... 220/787–794, 220/703, 4.21–4.25
See application file for complete search history.

(56) References Cited

U.S. PATENT DOCUMENTS

| | | | | |
|---|---|---|---|---|
| 2,985,354 | A | | 5/1961 | Aldington |
| 3,055,540 | A | | 9/1962 | Ringlen |
| 3,262,602 | A | | 7/1966 | McConnell et al. |
| 3,677,435 | A | | 7/1972 | Davis |
| 3,679,088 | A | | 7/1972 | Swett et al. |
| 3,743,133 | A | | 7/1973 | Rathbun |
| 3,977,563 | A | * | 8/1976 | Holt ..... 206/508 |
| 4,006,839 | A | | 2/1977 | Thiel et al. |
| 4,054,229 | A | | 10/1977 | Arfert |
| 4,210,258 | A | | 7/1980 | von Holdt |
| 4,266,689 | A | | 5/1981 | Asher |
| 4,349,119 | A | | 9/1982 | Letica |
| 4,351,448 | A | | 9/1982 | Ingersoll et al. |
| 4,446,986 | A | | 5/1984 | Bowen et al. |
| 4,562,937 | A | | 1/1986 | Iyengar |
| 4,640,435 | A | | 2/1987 | Dutt |
| 4,679,699 | A | | 7/1987 | Malsbury et al. |
| 4,721,210 | A | * | 1/1988 | Lawrence et al. ..... 206/459.1 |
| 4,934,557 | A | * | 6/1990 | Smith ..... 220/276 |
| 5,377,860 | A | | 1/1995 | Littlejohn et al. |
| 5,979,690 | A | | 11/1999 | Hartley |
| 6,460,716 | B1 | | 10/2002 | Wong |
| 6,688,487 | B1 | | 2/2004 | Oakes et al. |
| 2002/0037378 | A1 | * | 3/2002 | Littlejohn et al. ..... 428/36.5 |
| 2004/0094553 | A1 | * | 5/2004 | Crider et al. ..... 220/276 |
| 2004/0245261 | A1 | * | 12/2004 | Stanos et al. ..... 220/793 |

* cited by examiner

*Primary Examiner*—Lien M. Ngo
(74) *Attorney, Agent, or Firm*—Barnes & Thornburg LLP

(57) ABSTRACT

A liquid container includes a brim forming an opening into a liquid reservoir chamber formed in the cup. A lid is coupled to the brim to form more than one seal with the container. The lid includes lid-removal blocker walls arranged to engage undercuts formed in the cup to retain the lid in a mounted position on the cup closing the opening into the liquid reservoir chamber.

41 Claims, 5 Drawing Sheets

DRINK CUP AND LID

BACKGROUND

The present disclosure relates to drink cups, and particularly to lids for drink cups. More particularly, the present disclosure relates to a seal established between a drink cup and a lid mounted on the drink cup.

SUMMARY

According to the present disclosure, a liquid container comprises a cup including a brim, a floor, and a side wall extending from the brim toward the floor. The side wall includes a radially inwardly facing first annular seal surface. The brim includes a radially inwardly facing second annular seal surface, an axially upwardly facing third annular seal surface, and a radially outwardly facing fourth annular seal surface.

The liquid container also comprises a lid including a closure and a closure mount ring appended to the closure. The closure mount ring is coupled to the brim to retain the closure in a position closing a mouth opening into a liquid reservoir chamber formed in the cup.

In illustrative embodiments, the closure mount ring includes four seal rings. A first seal ring is arranged to engage the radially inwardly facing first annular seal surface on the cup to establish a first liquid flow barrier therebetween. A second seal ring is arranged to engage the radially inwardly facing second annular seal surface on the cup to establish a second liquid flow barrier therebetween. A third seal ring is arranged to engage the axially upwardly facing third annular seal surface on the cup to establish a third liquid flow barrier therebetween and a fourth seal ring is arranged to engage the radially outwardly facing fourth annular seal surface on the cup to establish a fourth liquid flow barrier therebetween.

In illustrative embodiments, two annular retainers are included in the lid to engage annular inner and outer portions of the cup to help retain the lid in a mounted position on the cup closing an opening into a liquid reservoir chamber formed in the cup. A first lid-removal blocker wall is included in the lid and arranged to engage an annular undercut formed in the cup during movement of the lid in an outer direction away from the floor of the cup to provide a first of the annular retainers and block unwanted removal of the lid from the cup. A second lid-removal blocker wall is included in a peripheral portion of the lid and is arranged to engage a terminal end of the brim of the cup during movement of the lid in the outer direction to provide a second of the annular retainers and assist in blocking unwanted removal of the lid from the cup.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
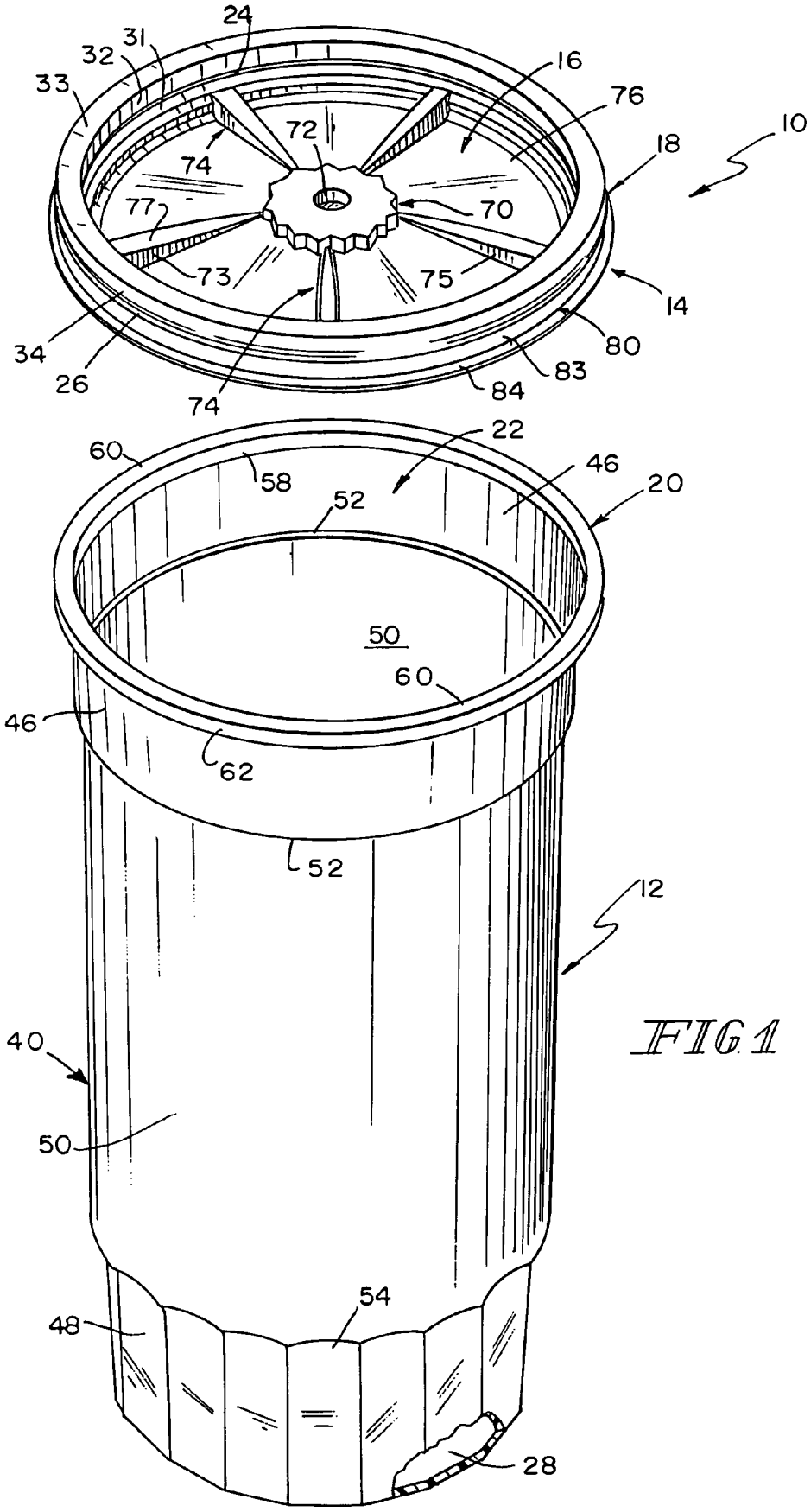
FIG. 1 is a perspective view of a lid and cup in accordance with the present disclosure before the lid is mounted on the cup.

A liquid container 10 includes a cup 12 and a lid 14 as shown in FIG. 1. Lid 14 includes a closure 16 and a closure mount 18 configured to be mounted on a brim 20 of cup 12 to arrange closure 16 to close an opening into a liquid reservoir chamber 22 formed in cup 12 as suggested in FIG. 6. Another lid 114 in accordance with the present disclosure is shown in FIGS. 7–12.

Figure 5:
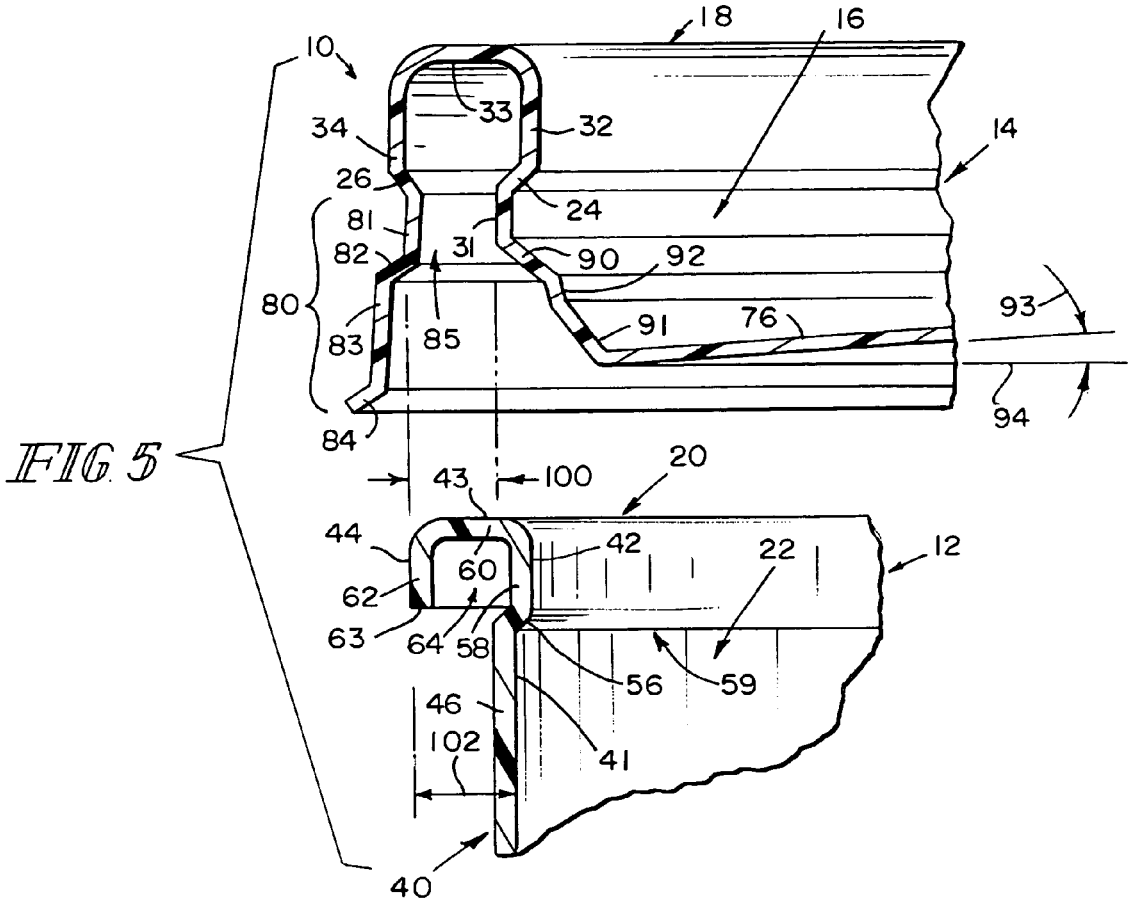
FIG. 5 is an enlarged sectional view of portions of the lid and cup of FIG. 1 before the lid is mounted on the cup.
Figure 6:
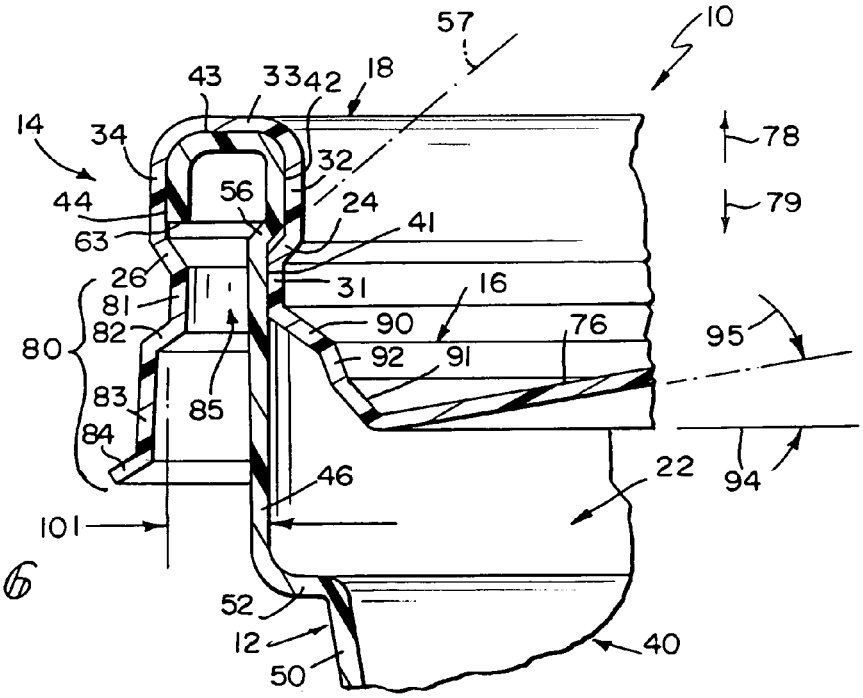
FIG. 6 is a view similar to FIG. 5 after the lid is mounted on the cup showing formation of a series of liquid flow barriers to retain liquid in a reservoir chamber formed in the cup owing to sealing engagement between the closure mount ring of the lid and both of a side wall and the brim of the cup and showing retention of the lid on the cup owing, in part, to engagement of a portion of the lid in an "undercut" formed on an interior surface of the cup at a junction between the side wall and the brim of the cup.
Figure 7:
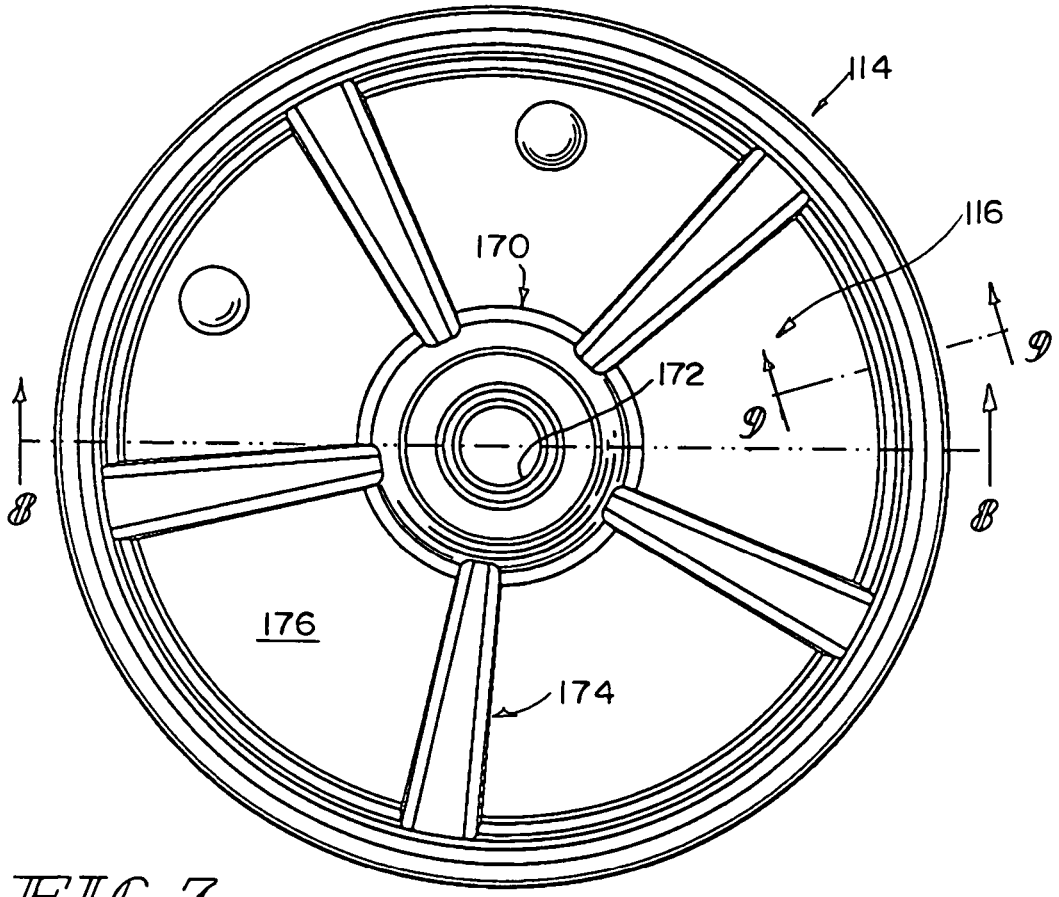
FIG. 7 is a top plan view of a lid in accordance with a second embodiment of the present disclosure.
Figure 8:
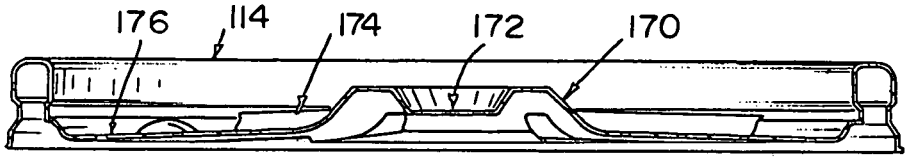
FIG. 8 is a sectional view taken along line 8—8 of FIG. 7.
Figure 9:
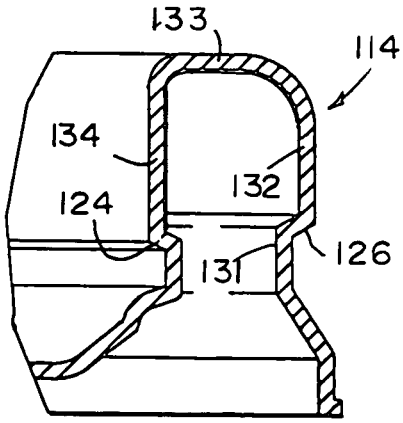
FIG. 9 is an enlarged view of a portion of the lid cross-section of FIG. 8.
Figure 10:
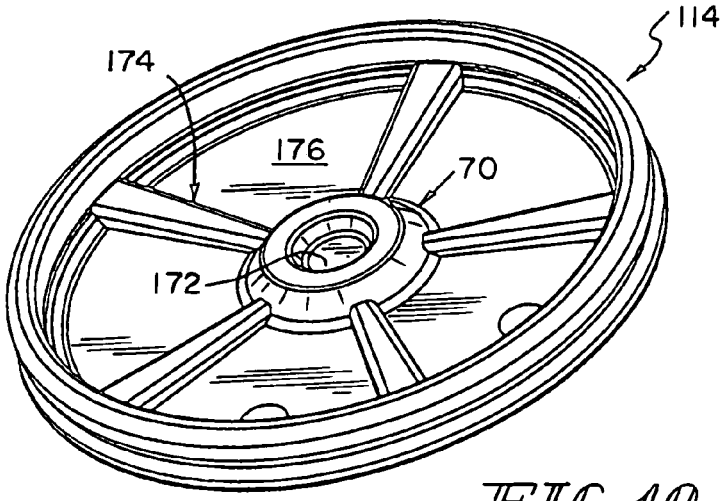
FIG. 10 is a perspective view of the lid of FIG. 7.
Figure 11:
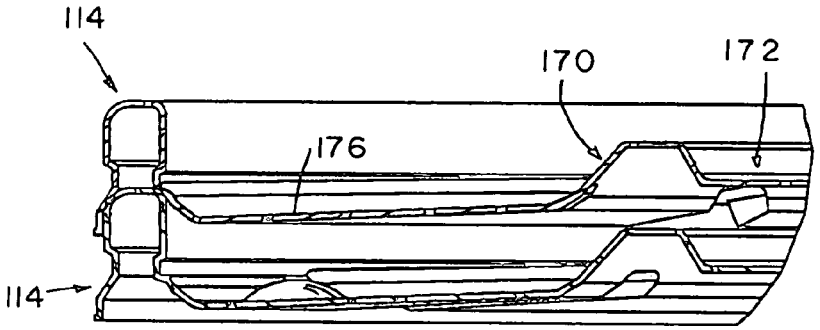
FIG. 11 is a sectional view (similar to FIG. 8) showing a stack comprising two of the lids shown in FIGS. 7 and 10.

In illustrative embodiments, retainers 24, 26 included in lid 14 are arranged to engage portions of cup 12 to block unwanted removal of lid 14 from cup 12 as suggested in FIGS. 5 and 6. Also in illustrative embodiments, four seal rings 31, 32, 33, and 34 are provided on lid 14 to engage companion annular seal surfaces 41, 42, 43, and 44 on cup 12 to establish four liquid flow barriers arranged in series near and on brim 20 to block unwanted discharge of liquid from liquid reservoir chamber 22 while lid 14 is in place on cup 12 as suggested in FIGS. 5 and 6.

As shown in FIG. 1, cup 12 includes brim 20, a floor 28, and a side wall 40 extending from brim 20 to floor 28. Side wall 40 is formed to include a large-diameter top portion 46 appended to brim 20, a small-diameter bottom portion 48, and a body portion 50 located between top and bottom portions 46, 48 as shown in FIG. 1. Side wall 40 also includes an annular top transitional portion 52 interconnecting top portion 46 and body portion 50 as shown, for example, in FIGS. 5 and 6. Side wall 40 also includes a "scalloped" annular bottom transitional portion 54 interconnecting body portion 50 and bottom potion 48 as suggested in FIG. 1.

As shown, for example, in FIG. 5, brim 20 includes, in series, a lid retainer 56, an inner annular strip 58, an annular bridge 60, and an outer annular strip 62. Lid retainer 56 is rooted to an upper portion of top portion 46 to anchor brim 20 to top portion 46. Outer annular strip 62 is oriented to lie in concentric relation to inner annular strip 58 and annular bridge 60 extends horizontally to link inner and outer annular strips 58, 62 as suggested in FIG. 5. Strips 58, 62 and bridge 60 cooperate to form a downwardly opening annular channel 64 above an exterior surface of lid retainer 56 in the illustrated embodiment. Outer annular strip 62 includes an axially downwardly facing annular terminal end 63.

Brim 20 is configured to form several seal surfaces arranged to mate with companion portions of lid 14 as suggested in FIGS. 5 and 6. Large-diameter top portion 46 includes radially inwardly facing first annular seal surface 41. Inner annular strip 58 includes second radially inwardly facing second annular seal surface 42. Annular bridge 60 includes axially upwardly facing third annular seal surface 43. Outer annular strip 62 includes radially outwardly facing fourth annular seal surface 44.

Lid retainer 56 is a frustoconical segment in the illustrated embodiment and extends from top portion 46 to inner annular strip 58 in a radially inwardly projecting, axially outwardly extending direction as shown in FIGS. 5 and 6. Lid retainer 56 is arranged to converge toward a reference point (not shown) located along reference line 57 and in spaced-apart relation to floor 28 to position lid retainer 56 therebetween to provide an undercut 59 under inner annular strip 58 as suggested in FIGS. 5 and 6. Annular terminal end 63 of outer annular strip 62 is arranged to extend around frustoconical lid retainer 56 as suggested in FIGS. 5 and 6.

Figure 2:
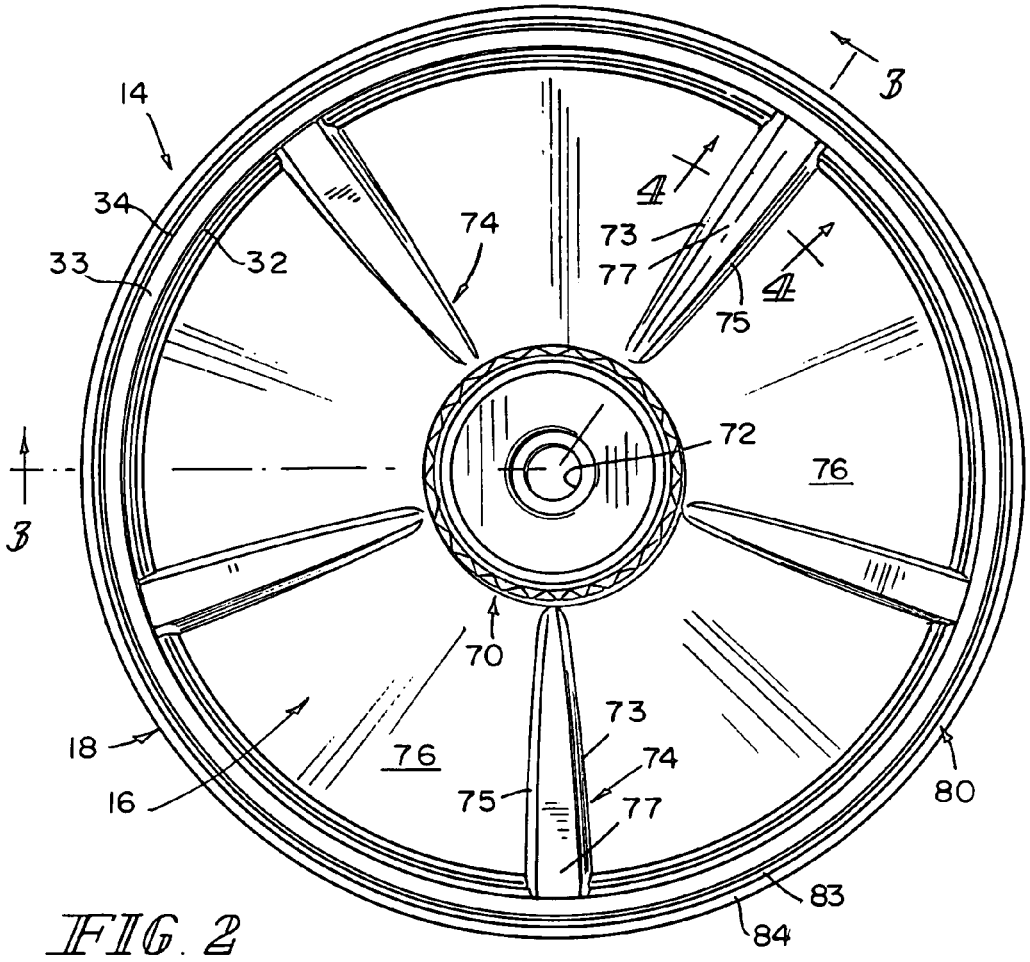
FIG. 2 is a top plan view of the lid of FIG. 1 showing a closure including a round hub providing a straw receiver, five radially extending spoke ribs terminating at the hub, and an inclined plate located between each pair of adjacent spoke ribs and showing a closure mount ring encircling the spoke ribs and inclined plates.
Figure 4:
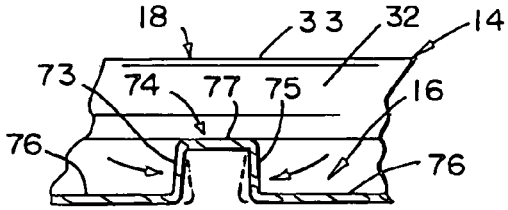
FIG. 4 is a transverse sectional view taken along line 4—4 of FIG. 2 showing one of the spoke ribs (in solid) when the lid is mounted on the cup as shown in FIG. 6 and showing deformation of that spoke rib (in phantom) of the type that would occur during mounting of the lid on the brim of the cup.

As shown in FIGS. 1 and 2, closure 16 of lid 14 includes a round hub 70 providing a straw receiver 72, five radially extending spoke ribs 74 terminating at hub 70, and an inclined plate 76 located between each pair of adjacent spoke ribs 74. In the illustrated embodiment, closure mount 18 is ring-shaped and arranged to encircle radially outermost portions of spoke ribs 74 and inclined plates 76. Each spoke rib 74 includes first and second side walls 73, 75 and a top wall 77 interconnecting side walls 73, 75 as suggested in FIGS. 2 and 4. Deformation of side walls 73, 75 of one of spoke ribs 74 during mounting of lid 14 on brim 20 of cup 12 is shown in phantom in FIG. 4.

Retainer 24 in lid 14 is defined by an annular first lid-removal blocker wall located between and arranged to interconnect first and second seal rings 31, 32. First lid-removal blocker wall 24 is arranged to engage frustoconical lid retainer 56 durig movement of lid 14 in an outer direction 78 (see FIG. 6) away from floor 28 of cup 12 to block unwanted removal of lid 14 form cup 12. In the illustrated embodiment, first lid-removal blocker wall 24 has a frustoconical shape. First lid-removal blocker wall 24 is configured to diverge in direction 79 toward floor 28 of cup 12 as suggested, for example, in FIG. 6. First lid retainer 56 is arranged to lie above and in confronting relation to first lid-removal blcoker wall 24 when closure monut 18 is coupled to brim 20 as suggested, for example, in FIG. 6. As suggested in FIG. 4, first seal ring 31 has a larger diameter than second seal ring 32.

Closure mount 18 further includes an annular lid-removal flange 80 located below fourth seal ring 34 and arranged to extend downwardly in an inner direction 79 opposite to outer direction 78. Retainer 26 included in lid 14 forms a part of closure mount 18 and is formed to provide a second lid-removal blocker wall. This second lid-removal blocker wall 26 is arranged to engage terminal end 63 of brim 20 during movement of lid 14 in outer direction 78 to block unwanted removal of lid 14 from cup 12.

Lid-removal flange 80 includes, in series, first, second, third, and fourth annular segments 81, 82, 83, and 84 as shown in detail in FIGS. 5 and 6. Second lid-removal blocker wall 26 has a frustoconical shape and is arranged to interconnect first annular segment 81 of lid-removal flange 80 and fourth seal ring 34 of closure mount 18. Each of the segments have frustoconical shapes of various slopes. Second lid-removal blocker wall 26 is configured to converge in direction 79 toward floor 28 of cup 12 as suggested, for example, in FIG. 6.

First annular segment 81 is arranged to surround first seal ring 31 to define an annular channel 85 therebetween. When lid 14 is mounted on brim 20 of cup 12, radially inwardly facing first annular seal surface 41 is located in annular channel 85 as shown, for example, in FIG. 6.

Referring to the illustration of closure mount 18 in FIG. 5, fourth seal ring 34 is aligned in concentric relation with second seal ring 32. The diameter of fourth seal ring 34 is greater than the diameters of first and second seal rings 31, 32. Closure mount 18 also includes an annular quarter round-shaped inner rim 86 interconnecting second and third seal rings 32, 33 and an annular quarter round-shaped outer rim 88 interconnecting third and fourth seal rings 33, 34 as suggested in FIG. 5. Second, third, and fourth seal rings 32, 33, 34 cooperate to define an annular chamber 89 communicating with annular channel 85 and receiving brim 20 therein when lid 14 is mounted on cup 12 as suggested in FIG. 6.

Figure 3:
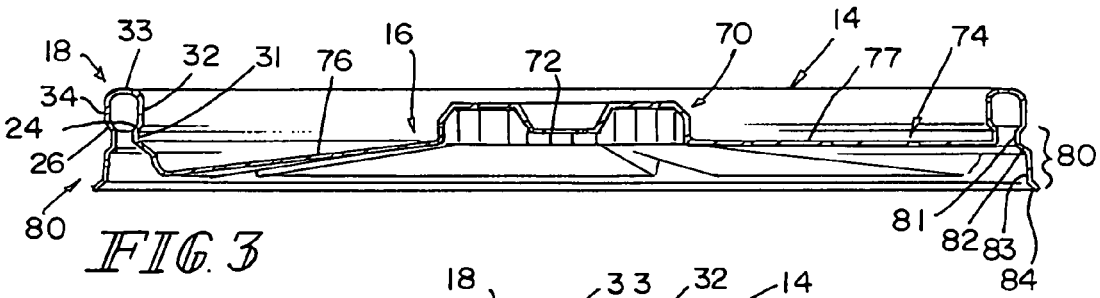
FIG. 3 is a sectional view of the lid taken along line 3—3 of FIG. 2 showing configuration of a downwardly opening annular brim receiver defined by the closure mount ring and sized to receive an annular brim of the cup therein as suggested in FIGS. 5 and 6.

Closure 16 includes a peripheral portion comprising outer frustoconical wall 90 appended to first seal ring 31, inner frustoconical wall 91 appended to inclined plates 76, and middle frustoconical wall 92 arranged to interconnect outer and inner frustoconical walls 90, 91 as shown in FIGS. 1, 3, and 5. These walls 90–92 cooperate to support inclined plates 76 as suggested in the drawings.

The slope of inclined plates 76 provided in lid 14 increases once lid 14 is mounted on cup 12. Owing, in part, to configuration of walls 90–92, a first of inclined plates 76 has a first slope (defined by first acute angle 93) with respect to a horizontal reference plane 94 before closure mount 18 is mounted on brim 20 of cup 12 as suggested in FIG. 5. That inclined plate 76 is moved to assume a steeper second slope (defined by second acute angle 95) with respect to horizontal reference plane 94 upon coupling of closure mount 18 on brim 20 as suggested in FIG. 6. As lid 14 is mounted on brim 20 of cup 12, dimension 100 between radially outwardly facing surfaces of first seal ring 31 and first annular segment 81 will increase as suggested by greater dimension 101 owing, in part, to dimension 102 between radially outwardly facing fourth annular seal surface 44 and radially outwardly facing surface of top portion 46 since dimension 102 is greater than dimension 100.

Lid 114 shown, for example, in FIGS. 7–12, incorporated many of the features associated with lid 14 shown, for example, in FIGS. 1–6. Retainers 124, 126 included in lid 114 are arranged to engage portions of cup 112 to block unwanted removal of lid 114 from cup 112 as suggested in FIG. 12. Four seal rings 131, 132, 133, and 134 are provided on lid 114 to engage companion annular seal surfaces 141, 142, 143, and 144 on cup 112 to establish four liquid flow barriers arranged in series near and on brim 120 of cup 112 to block unwanted discharge of liquid from a liquid reservoir chamber 122 in cup 112 while lid 114 is in place on cup 112 as suggested in FIG. 12.

Figure 12:
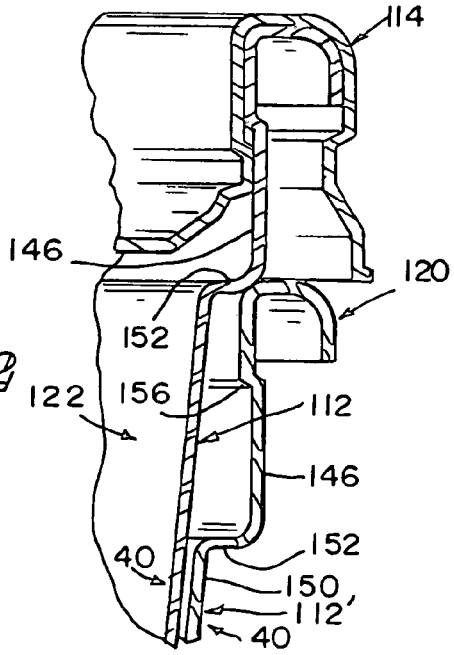
FIG. 12 is a partial sectional view showing a lid of the type shown in FIGS. 7–11 mounted on a first cup that is nested in an underlying second cup.

As shown, for example, in FIG. 12, cup 112 includes brim 120 and a side wall 140 extending downwardly from brim 120. Side wall 140 is formed to include a large-diameter top portion 146 appended to brim 120, a body portion 150 located under top portion 146, and an annular transitional portion 152 interconnecting top portion 146 and body portion 150. Brim 120 also includes a lid retainer 156 as suggested in FIG. 12.

Closure 116 of lid 114 includes a round hub 170 providing a straw receiver 172 and five radically extending spoke ribs 174 terminating at hub 170. Closure 116 also includes an inclined plate 176 located between each pair of adjacent spoke ribs 174. Lid 114 also includes a lid-removal flange 180 as suggested in FIGS. 8, 9, and 12.

The invention claimed is:

1. A liquid container comprising a cup including a brim, a floor, and a side wall extending from the brim toward the floor, the side wall including a radially inwardly facing first annular seal surface, the brim including a radially inwardly facing second annular seal surface, an axially upwardly facing third annular seal surface, and a radially outwardly facing fourth annular seal surface, and a lid including a closure and a closure mount ring appended to the closure and coupled to the brim to retain the closure in a position closing a mouth opening into a liquid reservoir chamber formed in the cup, the closure mount ring including a first seal ring arranged to engage the radially inwardly facing first annular seal surface to establish a first liquid flow barrier therebetween, a second seal ring arranged to engage the radially inwardly facing second annular seal surface to establish a second liquid flow barrier therebetween, a third seal ring arranged to engage the axially upwardly facing third annular seal surface to establish a third liquid flow barrier therebetween, and a fourth seal ring arranged to engage the radially outwardly facing fourth annular seal surface to establish a fourth liquid flow barrier therebetween, and wherein the brim includes an inner annular strip located above the side wall of the cup and a frustoconical lid retainer arranged to interconnect the inner annular strip and the side wall of the cup and to converge toward a reference point located in spaced-apart relation to the floor to position the frustoconical lid retainer therebetween to provide an undercut under the inner annular strip and the closure mount ring includes a first lid-removal blocker wall located between the first and second seal ring and arranged to engage the frustoconical lid retainer during movement of the lid in an outer direction away from the floor of the cup to block removal of the lid from the cup, and wherein the closure mount ring further includes a lid-removal flange located below the fourth seal ring and arranged to extend downwardly in an inner direction opposite to the outer direction.

2. The liquid container of claim 1 wherein the closure mount ring further includes a second lid-removal blocker wall located between the fourth seal ring and the lid-removal flange and arranged to engage a terminal end of the brim during movement of the lid in the outer direction to block removal of the lid from the cup.

3. The liquid container of claim 1 wherein the lid-removal flange includes, in series, first, second, third, and fourth annular segments, the first annular segment is arranged to surround the first seal ring, and the third and fourth annular segments have frustoconical shapes.

4. A liquid container comprising a cup including a brim, a floor, and a side wall extending from the brim toward the floor, the side wall including a radially inwardly facing first annular seal surface, the brim including a radially inwardly facing second annular seal surface, an axially upwardly facing third annular seal surface, and a radially outwardly facing fourth annular seal surface, and a lid including a closure and a closure mount ring appended to the closure and coupled to the brim to retain the closure in a position closing a mouth opening into a liquid reservoir chamber formed in the cup, the closure mount ring including a first seal ring arranged to engage the radially inwardly facing first annular seal surface to establish a first liquid flow barrier therebetween, a second seal ring arranged to engage the radially inwardly facing second annular seal surface to establish a second liquid flow barrier therebetween, a third seal ring arranged to engage the axially upwardly facing third annular seal surface to establish a third liquid flow barrier therebetween, and a fourth seal ring arranged to engage the radially outwardly facing fourth annular seal surface to establish a fourth liquid flow barrier therebetween, and wherein the first seal ring has a first diameter and the second seal ring has a second diameter that is lesser than the first diameter, and wherein the fourth seal ring is aligned in concentric relation with the second seal ring and has a third diameter that is greater than the first and second diameters and the closure mount ring further includes a frustoconical wall interconnecting the first and second seal rings.

5. The liquid container of claim 4 wherein each of the second and fourth seal rings is oriented to extend in a generally vertical direction and the third seal ring is oriented to extend in a generally horizontal direction.

6. The liquid container of claim 5 wherein the closure mount ring further includes an annular quarter round-shaped inner rim interconnecting the second and third seal rings.

7. The liquid container of claim 5 wherein the closure mount ring further includes an annular quarter round-shaped outer rim interconnecting the third and fourth seal rings.

8. A liquid container comprising a cup including a brim, a floor, and a side wall extending from the brim toward the floor, the side wall including a radially inwardly facing first annular seal surface, the brim including a radially inwardly facing second annular seal surface, an axially upwardly facing third annular seal surface, and a radially outwardly facing fourth annular seal surface, and a lid including a closure and a closure mount ring appended to the closure and coupled to the brim to retain the closure in a position closing a mouth opening into a liquid reservoir chamber formed in the cup, the closure mount ring including a first seal ring arranged to engage the radially inwardly facing first annular seal surface to establish a first liquid flow barrier therebetween, a second seal ring arranged to engage the radially inwardly facing second annular seal surface to establish a second liquid flow barrier therebetween, a third seal ring arranged to engage the axially upwardly facing third annular seal surface to establish a third liquid flow barrier therebetween, and a fourth seal ring arranged to engage the radially outwardly facing fourth annular seal surface to establish a fourth liquid flow barrier therebetween, wherein the closure mount ring includes a first annular segment arranged to surround the first seal ring to define an annular channel therebetween, the second, third, and fourth seal rings cooperate to define an annular chamber communicating with the annular channel and receiving the brim therein, and an upper portion of the side wall of the cup extends through the annular channel when the brim is located in the annular chamber, wherein the first seal ring has a first diameter and the second seal ring has a second diameter that is lesser than the first diameter.

9. A liquid container comprising a cup including a brim, a floor, and a side wall extending from the brim toward the floor, the side wall including a radially inwardly facing first annular seal surface, the brim including a radially inwardly facing second annular seal surface, an axially upwardly facing third annular seal surface, and a radially outwardly facing fourth annular seal surface, and a lid including a closure and a closure mount ring appended to the closure and coupled to the brim to retain the closure in a position closing a mouth opening into a liquid reservoir chamber formed in the cup, the closure mount ring including a first seal ring arranged to engage the radially inwardly facing first annular seal surface to establish a first liquid flow barrier therebetween, a second seal ring arranged to engage the radially inwardly facing second annular seal surface to establish a second liquid flow barrier therebetween, a third seal ring arranged to engage the axially upwardly facing third annular seal surface to establish a third liquid flow barrier therebetween, and a fourth seal ring arranged to engage the radially outwardly facing fourth annular seal surface to establish a fourth liquid flow barrier therebetween, wherein the closure mount ring includes a first annular segment arranged to surround the first seal ring to define an annular channel therebetween, the second, third, and fourth seal rings cooperate to define an annular chamber communicating with the annular channel and receiving the brim therein, and an upper portion of the side wall of the cup extends through the annular channel when the brim is located in the annular chamber, wherein the brim includes an inner annular strip located above the side wall of the cup and a frustoconical lid retainer arranged to interconnect the inner annular strip and the side wall of the cup and to converge toward a reference point located in spaced-apart relation to the floor to position the frustoconical lid retainer therebetween to provide an undercut under the inner annular strip and the closure mount ring includes a first lid-removal blocker wall located between the first and second seal ring and arranged to engage the frustoconical lid retainer during movement of the lid in an outer direction away from the floor of the cup to block removal of the lid from the cup.

10. The liquid container of claim 4 wherein the closure includes a hub formed to include a straw receiver, radially extending spoke ribs having an outer end terminating at the closure mount ring and an inner end terminating at the hub, and an inclined plate extending between each pair of adjacent radially extending spoke ribs and between the closure mount ring and the hub.

11. The liquid container of claim 10 wherein a first of the inclined plates has a first slope with respect to a horizontal reference plane before the closure mount ring of the lid is mounted on the brim of the cup and a steeper second slope with respect to the horizontal reference plane upon coupling of the closure mount ring on the brim.

12. A liquid container comprising a cup including a brim, a floor, and a side wall extending from the brim toward the floor, the side wall including a radially inwardly facing first annular seal surface, the brim including a radially inwardly facing second annular seal surface and a radially inwardly projecting, axially outwardly extending lid retainer located above the first annular seal surface and below the second annular seal surface, and a lid including a closure and a closure mount ring appended to the closure and coupled to the brim to retain the closure in a position closing a mouth opening into a liquid reservoir chamber formed in the cup, the closure mount ring including a first seal ring arranged to engage the radially inwardly facing first annular seal surface to establish a first liquid flow barrier therebetween, a second seal ring arranged to engage the radially inwardly facing second annular seal surface to establish a second liquid flow barrier therebetween, and a first lid-removal blocker wall located between the first and second seal rings and arranged to engage the lid retainer during movement of the lid in an outer direction away from the floor of the cup to block removal of the lid from the cup, and wherein the brim includes an inner annular strip located above the side wall of the cup and configured to include the radially inwardly facing second annular seal surface, the lid retainer has a frustoconical shape and is arranged to interconnect the inner annular strip and the side wall of the cup and to converge toward a reference point located in spaced-apart relation to the floor to position the lid retainer therebetween to provide an undercut under the inner annular strip, and the fourth sealing is aligned in concentric relation with the second seal ring.

13. The liquid container of claim 12 wherein the first lid-removal blocker wall has a frustoconical shape.

14. The liquid container of claim 12 wherein the first lid-removal blocker wall interconnects the first and second seal rings.

15. The liquid container of claim 14 wherein the first seal ring has a first diameter and the second seal ring has a second diameter that is lesser than the first diameter.

16. The liquid container of claim 12 wherein the first seal ring has a first diameter and the second seal ring has a second diameter that is lesser than the first diameter.

17. A liquid container comprising a cup including a brim, a floor, and a side wall extending from the brim toward the floor, the side wall including a first annular seal surface, the brim including a second annular seal surface, a third annular seal surface, and a fourth annular seal surface, each of the first, second, and fourth annular seal surfaces extending in a generally vertical direction, and the third annular seal surface extending in a generally horizontal direction, and a lid including a closure and a closure mount appended to the closure and coupled to the brim to retain the closure in a position closing a mouth opening into a liquid reservoir chamber formed in the cup, the closure mount including a first seal ring arranged to engage the first annular seal surface to establish a first liquid flow barrier therebetween, a second seal ring arranged to engage the second annular seal surface to establish a second liquid flow barrier therebetween, a third seal ring arranged to engage the third annular seal surface to establish a third liquid flow barrier therebetween, and a fourth seal ring arranged to engage the fourth annular seal surface to establish a fourth liquid flow barrier therebetween, and wherein the closure mount further includes a first lid-removal blocker wall arranged to interconnect the first and second seal rings and to engage an undercut formed in the cup during movement of the lid in an outer direction away from the floor of the cup to block removal of the lid from the cup, and wherein the brim further includes a lid-removal flange, the lid-removal flange includes, in series, first, second, third, and fourth annular segments, the first annular segment is arranged to surround the first seal ring, and the third and fourth annular segments have frustoconical shapes, and wherein the first seal ring has a first diameter and the second seal ring has a second diameter that is lesser than the first diameter.

18. A liquid container comprising a cup including a brim, a floor, and a side wall extending from the brim toward the floor, the side wall including a first annular seal surface, the brim including a second annular seal surface, a third annular seal surface, and a fourth annular seal surface, each of the first, second, and fourth annular seal surfaces extending in a generally vertical direction, and the third annular seal surface extending in a generally horizontal direction, and a lid including a closure and a closure mount appended to the closure and coupled to the brim to retain the closure in a position closing a mouth opening into a liquid reservoir chamber formed in the cup, the closure mount including a first seal ring arranged to engage the first annular seal surface to establish a first liquid flow barrier therebetween, a second seal ring arranged to engage the second annular seal surface to establish a second liquid flow barrier therebetween, a third seal ring arranged to engage the third annular seal surface to establish a third liquid flow barrier therebetween, and a fourth seal ring arranged to engage the fourth annular seal surface to establish a fourth liquid flow barrier therebetween, and wherein the first seal ring has a first diameter and the second seal ring has a second diameter that is lesser than the first diameter, and wherein the fourth seal ring is aligned in concentric relation with the second seal ring and has a third diameter that is greater than the first and second diameters.

19. The liquid container of claim 17 wherein the closure mount further includes an annular quarter round-shaped inner rim interconnecting the second and third seal rings.

20. A liquid container comprising a cup including a brim, a floor, and a side wall extending from the brim toward the floor, the brim including a vertical annular seal surface, a horizontal annular seal surface, a first lid retainer extending into a liquid reservoir chamber formed in the cup, and a second lid retainer lying outside the liquid reservoir chamber formed in the cup and in spaced-apart relation to the first lid retainer to locate the vertical and horizontal annular seal surfaces therebetween, the brim providing a radially outwardly turned lip terminating at the second lid retainer and lying outside of the liquid reservoir chamber, and a lid including a closure and a closure mount appended to the closure and coupled to the brim to retain the closure in a position closing a mouth opening into the liquid reservoir chamber formed in the cup, the closure mount engaging at least the vertical annular seal surface of the brim to establish a liquid flow barrier therebetween, the closure mount including a first lid-removal blocker wall arranged to engage the first lid retainer of the brim during movement of the lid in an outer direction away from the floor of the cup to block removal of the lid from the cup, the closure mount also including a second lid-removal blocker wall arranged to engage the second lid retainer of the brim during movement of the lid in an outer direction away from the floor of the cup to block removal of the lid from the cup.

21. The liquid container of claim 20 wherein the lid further includes a lid-removal flange coupled to the second lid-removal blocker wall and arranged to extend downwardly away from the second lid-removal blocker wall to terminate at a point below the brim.

22. The liquid container of claim 21 wherein the lid-removal flange is arranged to lie outside of the liquid reservoir chamber formed in the cup.

23. The liquid container of claim 20 wherein the lid further includes a lid-removal flange arranged to lie outside of the liquid reservoir chamber formed in the cup when the closure mount is coupled to the brim.

24. The liquid container of claim 23 wherein the lid-removal flange is arranged to lie below the second lid retainer when the closure mount is coupled to the brim.

25. The liquid container of claim 20 wherein each of the first and second lid-removal blocker walls has a frustoconical shape.

26. The liquid container of claim 25 wherein the first lid-removal blocker wall is configured to diverge in a direction toward the floor of the cup and the second lid-removal blocker wall is configured to converge in a direction toward the floor of the cup.

27. The liquid container of claim 26 wherein the first lid retainer is a frustoconical segment and is arranged to lie above and in confronting relation to the first lid-removal blocker wall when the closure mount is coupled to the brim.

28. The liquid container of claim 20 wherein the brim includes an inner annular strip located above the side wall of the cup, the first lid retainer has a frustoconical shape and is arranged to interconnect the inner annular strip and the side wall of the cup and to converge toward a reference point located in spaced-apart relation to the floor to position the first lid retainer therebetween to provide an undercut under the inner annular strip.

29. The liquid container of claim 28 wherein the first lid-removal blocker wall has a frustoconical shape.

30. A liquid container comprising a cup including a brim, a floor, and a side wall extending from the brim toward the floor, the brim including a first lid retainer extending into a liquid reservoir chamber formed in the cup, and a second lid retainer lying outside the liquid reservoir chamber formed in the cup, and a lid including a closure and a closure mount appended to the closure and coupled to the brim to retain the closure in a position closing a mouth opening into the liquid reservoir chamber formed in the cup, the closure mount engaging at least the vertical annular seal surface of the brim to establish a liquid flow barrier therebetween, the closure mount including a first lid-removal blocker wall arranged to engage the first lid retainer of the brim during movement of the lid in an outer direction away from the floor of the cup to block removal of the lid from the cup, the closure mount also including a second lid-removal blocker wall arranged to engage the second lid retainer of the brim during movement of the lid in an outer direction away from the floor of the cup to block removal of the lid from the cup, wherein the brim includes an inner annular strip located above the side wall of the cup, the first lid retainer has a frustoconical shape and is arranged to interconnect the inner annular strip and the side wall of the cup and to converge toward a reference point located in spaced-apart relation to the floor to position the first lid retainer therebetween to provide an undercut under the inner annular strip, and wherein the side wall includes a radially inwardly facing first annular seal surface having a first diameter, the inner annular strip of the brim includes a radially inwardly facing second annular seal surface having a second diameter that is less than the first diameter, the first lid retainer is located above the first annular seal surface and below the second annular seal surface, the closure mount includes a first seal ring arranged to engage the radially inwardly facing first annular seal surface and a second seal ring arranged to engage the radially inwardly facing second annular seal surface, and the first lid removal blocker wall is located between the first and second seal rings.

31. The liquid container of claim 20 wherein the side wall includes a first annular seal surface, the closure mount includes a first seal ring arranged to engage the first annular seal surface to establish a first liquid flow barrier therebetween.

32. The liquid container of claim 31 wherein the brim further includes an annular seal surface and the closure mount includes another seal ring arranged to engage the annular seal surface of the brim to establish a liquid flow barrier therebetween.

33. The liquid container of claim 31 wherein the brim further includes radially inwardly and axially upwardly facing seal surfaces and the closure mount includes a separate seal ring arranged to engage each of the radially inwardly and axially upwardly facing seal surfaces to establish a liquid flow barrier therebetween.

34. The liquid container of claim 31 wherein the brim further includes radially inwardly and outwardly facing seal surfaces and the closure mount includes a separate seal ring arranged to engage each of the radially inwardly and outwardly facing seal surfaces to establish a liquid flow barrier therebetween.

35. The liquid container of claim 31 wherein the brim further includes axially upwardly and radially outwardly facing seal surfaces and the closure mount includes a separate seal ring arranged to engage each of the axially upwardly and radially outwardly facing seal surfaces to establish a liquid flow barrier therebetween.

36. The liquid container of claim 31 wherein the brim further includes radially inwardly, axially upwardly, and radially outwardly facing seal surfaces and the closure mount includes a separate seal ring arranged to engage each of the radially inwardly, axially upwardly, and radially outwardly facing seal surfaces.

37. The liquid container of claim 20, wherein the brim further includes radially inwardly and axially upwardly facing seal surfaces and the closure mount includes a separate seal ring arranged to engage each of the radially inwardly and axially upwardly facing seal surfaces to establish a liquid flow barrier therebetween.

38. The liquid container of claim 20 wherein the brim further includes radially inwardly and outwardly facing seal surfaces and the closure mount includes a separate seal ring arranged to engage each of the radially inwardly and outwardly facing seal surfaces to establish a liquid flow barrier therebetween.

39. The liquid container of claim 20 wherein the brim further includes axially upwardly and radially outwardly facing seal surfaces and the closure mount includes a separate seal ring arranged to engage each of the axially upwardly and radially outwardly facing seal surfaces to establish a liquid flow barrier therebetween.

40. The liquid container of claim 20 wherein the brim further includes radially inwardly, axially upwardly, and radially outwardly facing seal surfaces and the closure mount includes a separate seal ring arranged to engage each of the radially inwardly, axially upwardly, and radially outwardly facing seal surfaces.

41. A liquid container comprising a cup including a brim having an inverted U-shaped cross-sectional shape, a floor, a side wall extending from the brim toward the floor, a mouth opening into a liquid reservoir chamber formed in the cup, a first lid retainer extending into the liquid reservoir chamber formed in the cup, and a second lid retainer lying outside the liquid reservoir chamber formed in the cup, and a lid coupled to the brim to retain the closure in a first position closing the mouth opening into the liquid reservoir chamber whereby first, second and third lid seals are formed in the first position to block unwanted discharge of liquid from the liquid reservoir chamber, the first and third seals being formed by opposing generally vertically extending cup and lid surfaces, the second seal being formed by opposing generally horizontally extending cup and lid surfaces, a first lid-removal blocker wall arranged to engage the first lid retainer during movement of the lid in an outer direction away from the floor of the cup to block removal of the lid from the cup, a second lid-removal blocker wall arranged to engage the second lid retainer during movement of the lid in an outer direction away from the floor of the cup to block removal of the lid from the cup, whereby movement of the lid in an outer direction away from the floor of the cup from the first position to a second position separates the opposing generally horizontally extending cup and lid second seal surfaces and engages at least one of the first lid-removal blocker with the first lid retainer and the second lid-removal blocker wall with the second lid retainer to block removal of the lid from the cup.

* * * * *